United States Patent [19]

DiCarlo et al.

[11] Patent Number: 4,589,263

[45] **Date of Patent: * May 20, 1986**

[54] MULTIPLE COMPRESSOR OIL SYSTEM

[75] Inventors: Leonard J. DiCarlo, Maryland Heights; Roland A. Ares, St. Charles; Robert O. Norton, Chesterfield, all of Mo.

[73] Assignee: Hussmann Corporation, Bridgeton, Mo.

[ * ] Notice: The portion of the term of this patent subsequent to Mar. 12, 2002 has been disclaimed.

[21] Appl. No.: 662,029

[22] Filed: Oct. 18, 1984

Related U.S. Application Data

[60] Continuation-in-part of Ser. No. 599,347, Apr. 12, 1984, Pàt. No. 4,503,685, which is a division of Ser. No. 442,967, Nov. 19, 1982, Pat. No. 4,478,050.

[51] Int. Cl.[4] ..... F25B 31/00

[52] U.S. Cl. ..... 62/193; 62/510

[58] Field of Search ..... 62/192, 193, 470, 469, 62/468, 510, 210, 212

[56] References Cited

U.S. PATENT DOCUMENTS

| | | | |
|---|---|---|---|
| 2,606,430 | 8/1952 | Pownall | 62/192 |
| 2,665,557 | 1/1954 | Dobson | 62/193 |
| 3,633,377 | 1/1972 | Quick | 62/192 |
| 3,766,745 | 10/1973 | Quick | 62/510 X |
| 4,503,685 | 3/1985 | DiCarlo et al. | 62/193 |

FOREIGN PATENT DOCUMENTS

| | | | |
|---|---|---|---|
| 116134 | 2/1930 | Austria | 62/470 |

*Primary Examiner*—Harry Tanner

*Attorney, Agent, or Firm*—Richard G. Heywood

[57] ABSTRACT

An oil return system for a multiple compressor refrigeration system in which said compressors have a common discharge and at least two of said compressors have their low pressure suction side connected to operate at substantially different suction pressures, said oil return system having oil and refrigerant separating means connected to receive the common discharge from said compressors and oil delivery means constructed and arranged to maintain compressor oil levels at the suction side of the respective compressors, and oil control valve means disposed between said separating means and oil delivery means for each of said two compressors, said oil control valve means for each such compressor having pressure means for maintaining the downstream oil pressure to the oil delivery means at a preselected value.

9 Claims, 6 Drawing Figures

MULTIPLE COMPRESSOR OIL SYSTEM

This continuation-in-part application is based upon co-pending patent application Ser. No. 599,347 filed Apr. 12, 1984 (now U.S. Pat. No. 4,503,685) as a division of parent application Ser. No. 442,967 filed Nov. 19, 1982 (now U.S. Pat. No. 4,478,050).

BACKGROUND OF THE INVENTION

The invention relates generally to the commercial and industrial refrigeration art, and more particularly to a multiple compressor oil system for commercial and industrial refrigeration.

The maintenance of a proper amount of lubricating oil in the compressor of any refrigeration system obviously is a critical factor to the efficient operation and life span of the compressor. Oil problems are particularly acute in large multiplexed or compounded systems in which multiple compressors operate in parallel or series-piped arrangements and pump into a common discharge header to provide the refrigeration needs of commercial installations, such as supermarkets which have a large number of low and/or normal temperature refrigerated display and storage fixtures, or for industrial installations, such as warehousing having a plurality of different refrigeration requirements.

In all operating refrigeration systems, some amount of oil is entrained in the hot compressed refrigerant vapor discharged by the compressors and generally some oil is present throughout the entire system, including condenser, receiver, evaporator coils, liquid and suction lines, valves, etc. It is clear that compressor lubricating oil serves no useful purpose outside the compressor, that energy is wasted by pushing oil through the refrigeration system, that oil interfers with the heat transfer and efficiency of evaporators and that oil may create system damage due to oil build-up interferring with proper refrigerant distribution, valve operation and the like. Therefore, high side oil traps or separators have been employed between the compressor and condenser to separate the oil from the refrigerant that is passed on to the condenser and thus minimize such oil distribution through the system. It is desired to return the oil in liquid form to the compressors and various high side and low side oil devices have been used, such as sumps, accumulators, pumps, oil float controls, valves and the like.

Refrigerants such as R-12, R-22 and R-502 are miscible with the lubricating oil, and generally some amount of refrigerant will be present in any oil separation system. However, in prior oil separator systems, the cooling of separated oil below the condensing temperature of the gas refrigerant frequently produced excessive refrigerant condensation in and dilution of the oil. Such oil and refrigerant solution results in reduction of lubrication quality and excessive pump-out of the oil into the system. Excessive oil foaming also occurred in some cases of crankcase pressure reduction such as during compressor start-up following a long off-cycle. In addition to problems of inefficient oil-refrigerant separation, a major problem has been the maintenance of proper oil levels between multiple and cyclically operating compressors. A typical solution in the past was to return the oil to the suction header for the compressors and allow the oil to flow into the warm refrigerant vapor and at random into the compressors without regard to different pumping rates, and then attempt to provide an oil level equalizing connection between the compressor crankcases, such as is disclosed in U.S. Pat. No. 3,140,041. U.S. Pat. No. 3,633,377 also discusses a high side oil separator, accumulator and muffler for a multiple compressor system that approaches some of the oil problems.

While numerous oil separation devices and systems have been developed in the past, efficient oil separation and maintenance of proper oil levels in multiple compressor systems has continued to present oil problems in refrigeration systems.

SUMMARY OF THE INVENTION

The invention is embodied in a multiple compressor oil system for efficient oil separation and return in commercial refrigeration systems and the like having multiple parallel compressors that are cyclically operable to meet the refrigeration demands of the system, the oil flow control means maintaining a predetermined oil level in the compressors and including a pressure differential valve for regulating the flow of oil from an oil separator to the system compressors.

A principal object of the present invention is to provide an oil separation and return system having a controlled oil delivery to maintain predetermined oil levels for optimum compressor lubrication in a multiple compressor system.

Another object is to provide an oil return system that obviates oil flooding and starving and maintains a substantially constant supply of oil to multiple refrigeration compressors operating at different suction pressures.

It is another object to provide an oil system having efficient pressure responsive valve means for controlled oil delivery to the oil float units for feeding different refrigeration compressors.

Another object is to provide an efficient, easily serviced and economic oil return system for a multiple compressor refrigeration system.

These and other objects and advantages will become more apparent hereinafter.

DESCRIPTION OF THE DRAWINGS

For illustration and disclosure purposes the invention is embodied in the parts and the combinations and arrangements of parts hereinafter described. In the accompanying drawings forming a part of the specification and wherein like numerals refer to like parts wherever they occur.

DESCRIPTION OF THE PREFERRED EMBODIMENTS

In parent application Ser. No. 442,967 (now U.S. Pat. No. 4,478,050), a closed refrigeration system was illustrated and described as being of the multiplexed type having dual or twin parallel compressors and installed in a supermarket for operating a plurality of separate refrigerated storage and display cases at about the same suction pressure, but it has now been determined that the oil control and pressure differential means of the invention are adaptable to multiple compressor systems operating at widely different suction pressures. The term "high side" is used herein in a conventional refrigeration sense to mean the portion of the system from the compressor discharge to the evaporator expansion valves and the term "low side" means the portion of the system from the expansion valves to the compressor suction.

Figure 1:
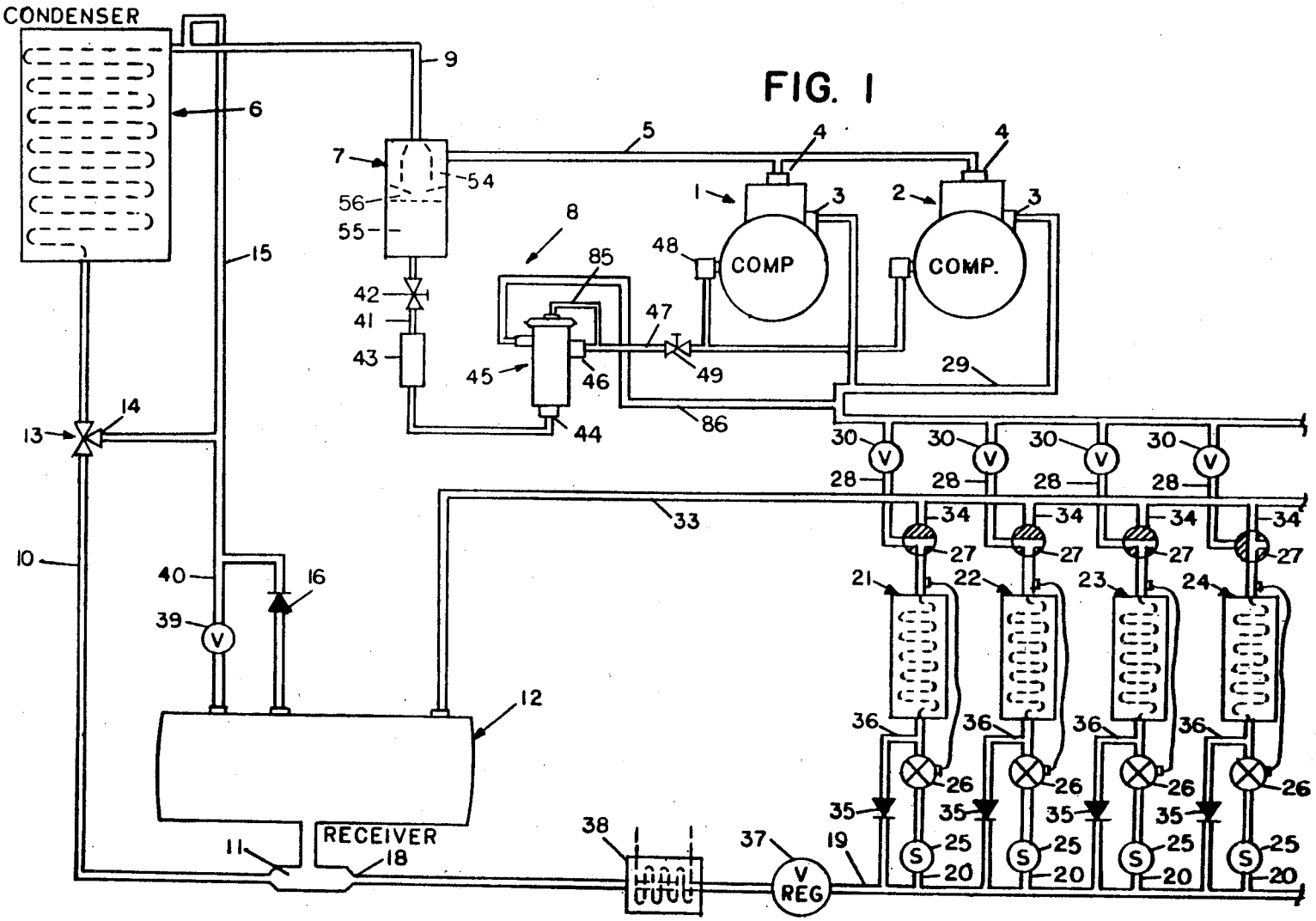
FIG. 1 is a diagrammatic view of a typical refrigeration system embodying the invention.

Referring to FIG. 1, the basic refrigeration system shown includes a pair of compressors 1 and 2 connected in parallel and each having a suction or low pressure side with a suction service valve 3 operating at a predetermined suction pressure and having a discharge or high pressure side 4 connected to a common discharge header 5 through which hot compressed gaseous refrigerant is discharged to a condenser 6. The discharge header 5 is connected to an oil separator 7 of an oil separation and return system 8 embodying the present invention and a refrigerant outlet from the oil separator 7 is connected to discharge conduit 9 connected to the condenser 6. Thus, the oil separation system 8 is disposed in the high side refrigerant discharge between the compressors and the condenser. The refrigerant is reduced to its condensing temperature and pressure in the condenser 6 which is connected by a conduit 10 to an enlarged T-connection conduit or base 11 forming part of a surge-type receiver 12 forming a liquid refrigerant source for operating the system. A pressure responsive flooding valve 13 in the conduit 10 operates in response to a head pressure pilot control 14, which is connected to a pressure equalizing line 15 between the receiver 12 and condenser 6 to restrict condensate flow from the condenser and produce variable condenser flooding to maintain compressor head pressures at or above a preselected minimum. The equalizing line has a check valve 16. The outlet 18 of the receiver 12 is connected to a liquid header 19 for conducting liquid refrigerant to branch liquid lines or conduits 20 leading to evaporator coils 21, 22, 23 and 24 associated with different refrigerated fixtures (not shown) and being representative of numerous evaporators connected into the refrigerant system. The branch liquid line 20 of each evaporator 21, 22, 23 and 24 is provided with a solenoid valve 25, and expansion valves 26 meter refrigerant into the evaporators in a conventional manner. The outlets of the evaporators are connected to three-way valves 27 and, under normal refrigerating operation, are connected through these valves and branch suction lines or conduits 28 to a suction header 29 connected to the suction side 3 of the compressors 1 and 2 and though which vaporous refrigerant from the evaporators is returned to the compressors to complete the basic refrigeration cycle. Evaporator pressure regulator (EPR) valves 30 are shown interposed in the branch suction lines 28 to illustrate that the suction pressure on the evaporator coils 21, 22, 23 and 24 can be adjusted so that the respective refrigerated fixtures can operate within a range of different temperatures established by the suction pressure of the compressors 1 and 2.

The refrigeration system operates conventionally in that each fixture evaporator absorbs heat from the fixture or its product load thereby heating and vaporizing the refrigerant and resulting in the formation of frost or ice on the evaporator coils. The refrigerant gas returned to the compressors has a cumulative latent heat load in excess of the amount of heat required to defrost the evaporators 21, 22, 23 and 24. A hot gas defrosting system includes a main gas defrost header 33 connected to the top of the receiver 12 for conducting saturated gaseous refrigerant selectively to the evaporator coils and is connected through branch defrost lines or conduits 34 to the three-way valves 27, the three-way valve for the evaporator 24 being shown in defrost position. In the gas defrost arrangement shown, the sensible and latent heat of gaseous refrigerant is used for defrosting the evaporators and saturated gaseous refrigerant flows through the header 33, the branch line 34 and the three-way valve 27 into the selected evaporator coil 24 for heating and defrosting the coil thereby condensing the refrigerant to a liquid as in a conventional condenser. The solenoid valve 25 is closed to isolate the defrosting evaporator from its normal refrigeration connection to the liquid line 19, and a check valve 35 is provided in by-pass line 36 around the expansion valve 26 to return the defrost condensate to the liquid line 19 as taught by U.S. Pat. No. 3,150,498 so that such refrigerant is immediately available for use in the normal operation of the refrigerating evaporators. A pressure reducing valve 37 is positioned in the liquid header 19 to effect a downstream pressure reduction in the range of 10–20 psig in the liquid line 19 relative to the pressure in the defrost header 33, and the liquid header may also be provided with a conventional evaporative sub-cooler 38 for preventing flash gas. In addition, as the compressor discharge line 9 downstream of the oil separation system 8 is connected by the equalizing line 15 to the receiver 12, a pressure regulating valve 39 may be provided in a branch conduit 40 also connected to the receiver 12 in by-pass relation to the one-way check valve 16 to maintain a substantially constant head in the receiver and a continuous supply of saturated gas during defrost operations. The construction and operation of the system so far described will be fully understood by reference to U.S. Pat. No. 3,427,819.

The oil separation system 8 shown in FIGS. 1, 2, 4 and 6 includes the oil separator unit 7, which is fully described in parent application Ser. No. 442,967 (U.S. Pat. No. 4,478,050) and a divisional application Ser. No. 599,468 co-pending herewith (U.S. Pat. No. 4,506,523). The unit 7 includes an upper refrigerant vapor and oil receiving and separating chamber 54, a lower oil accumulator or reservoir chamber 55 and an intermediate oil precipitating or liquifying chamber 56. In operation, the compressor discharge into the separator chamber 54 impinges against a coarse screen surface to induce adherence of oil particles which accumulate and run down toward the intermediate chamber 56 which has an oil precipitating member to precipitate or condense oil into a liquid form so that this oil will pass in the form of liquid oil droplets and form a supply of liquid oil in the accumulator chamber 55. An oil line 41 connects the bottom of the reservoir 55 through a service valve 42 and filter 43 to the inlet 44 of a pressure differential valve 45, which has an oil outlet 46 connected by an oil return line 47 to conventional oil float valves 48 sensing the oil level in the respective compressor crankcases and controlling the amount of oil returned thereto. Another service shut-off valve 49 is interposed in the oil return line 47 downstream of the pressure differential valve 45. The function of the pressure differential valve 45 is to reduce the high pressure prevailing in the oil separation unit 7 to a pressure slightly greater than the suction pressure of the compressors 1 and 2 to regulate oil flow into the oil return line 47 and prevent overfeeding of the oil float valves 48.

Figure 2:
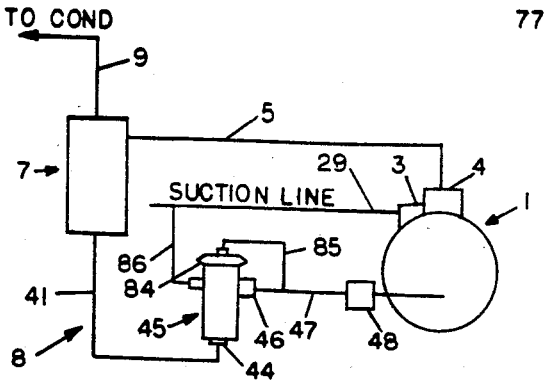
FIG. 2 is a line diagram illustrating an oil return system connected with one form of pressure differential valve used in the invention.
Figure 3:
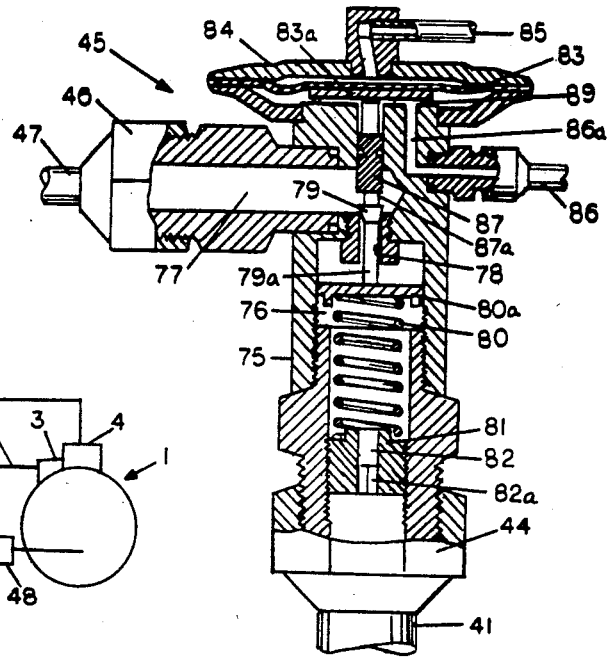
FIG. 3 is an enlarged cross-sectional view of the embodiment of the pressure differential valve shown in FIG. 2.

Referring now to FIGS. 2 and 3 wherein one form of an oil pressure differential valve 45 embodying the invention is illustrated diagrammatically and in cross-section, the valve has a main valve body 75 with a central oil inlet chamber 76 connected by inlet coupler 44 to the oil line 41 and an oil outlet chamber 77 connected by outlet coupler 46 to the oil return line 47. These chambers 76 and 77 are connected by an oil passage 78 controlled by a valve element 79 biased toward an open oil flow position by pressure spring 80, which has an adjustable lock nut 81 with a through passage 82 and Allen wrench socket 82*a* to vary the pressure setting. Opening and closing of the valve element 79 is regulated by a pressure responsive diaphragm 83 mounted in a valve control head 84, the upper surface of the diaphragm 83 being in fluid pressure communication with the oil return line 47 through an equalizing line 85 and the lower diaphragm surface being in communication with the suction line 29 through an equalizer conduit 86. It should be noted that the valve 79 is biased upwardly toward an open position by action of the spring 80 acting on spring retainer 80*a* and through valve stem 79*a*, but that the valve 79 is also controlled by the diaphragm 83 acting on pressure plate 83*a* and through a plunger 87 and upper valve stem 87*a* upon the valve head 79 in opposition to the spring force. The plunger 87 is sealably movable in bore 88, and the diaphragm pressure plate 83*a* normally seats on spaced lugs 89 on the main valve body 75 so that the suction pressure established through line 86 and cross-bores 86*a* is effective on the entire lower diaphragm area.

The purpose of the pressure regulating valve 45 is to reduce the high side pressure acting on the oil levels in the reservoir unit 55 to a preselected value in the range of the low side or suction pressure so that the oil float valves 48 can operate efficiently in controlling oil make-up levels to the compressor crankcases. The valve 45 has an adjustment range of about 5 to 40 psig differential pressure, which adjustment is carried out by closing off service valves 42 and 49 and removing the inlet coupling 44 so that the spring lock nut 82 can be rotated to increase or decrease the pressure setting. In this manner an oil inlet pressure of about 175 psig may be reduced to an oil outlet pressure of about 50 psig with a suction line equalization to about 30 psig. It should be noted that the pressure regulating valve 45 is not responsive to variable compressor head pressure, which therefore does not become part of the oil regulating equation, and the differential established is between the pressure of the oil return line itself and the suction pressure.

Figure 4:
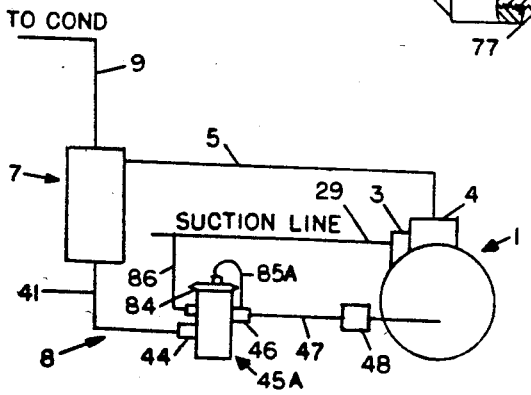
FIG. 4 is a line diagram illustrating an oil return system connected with another form of pressure differential valve used in the invention.
Figure 5:
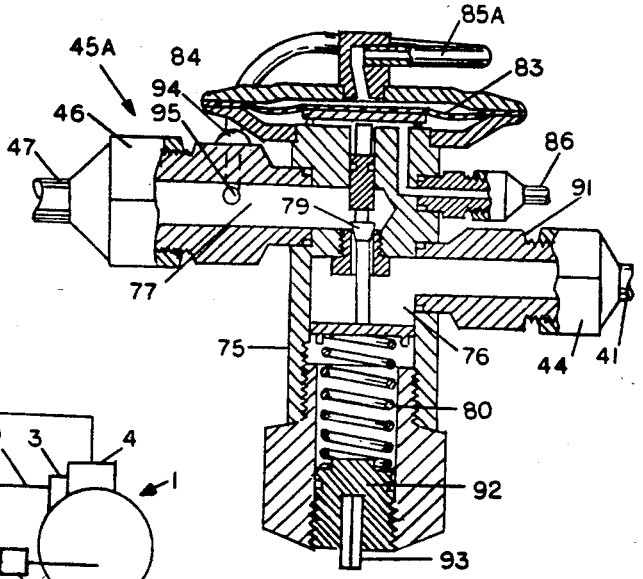
FIG. 5 is an enlarged cross-sectional view of the embodiment of the pressure differential valve shown in FIG. 4.

Referring now to FIGS. 4 and 5, the pressure regulating valve 45A is similar in construction and operation to that of FIGS. 2 and 3, except for two changes. The oil inlet line 41 is coupled to an inlet fitting 9 connected to the chamber 76 through the side wall of the main valve body 75 and the spring lock nut 92 is imperforate and seals the lower end of the chamber 76 and has its adjustment lock nut 93 directly accessible at the lower end of the valve 45 whereby spring tension and adjustment of its pressure setting can be made directly at the bottom opening of the housing without disconnecting any oil connection or shutting down the system 8. The other major change in the valve 45A is to provide the oil equalizing line 85A with a direct connection 94 and internal port 95 to the oil outlet chamber 77 thereby simplifying installation and servicing of the oil separation system 8.

Figure 6:
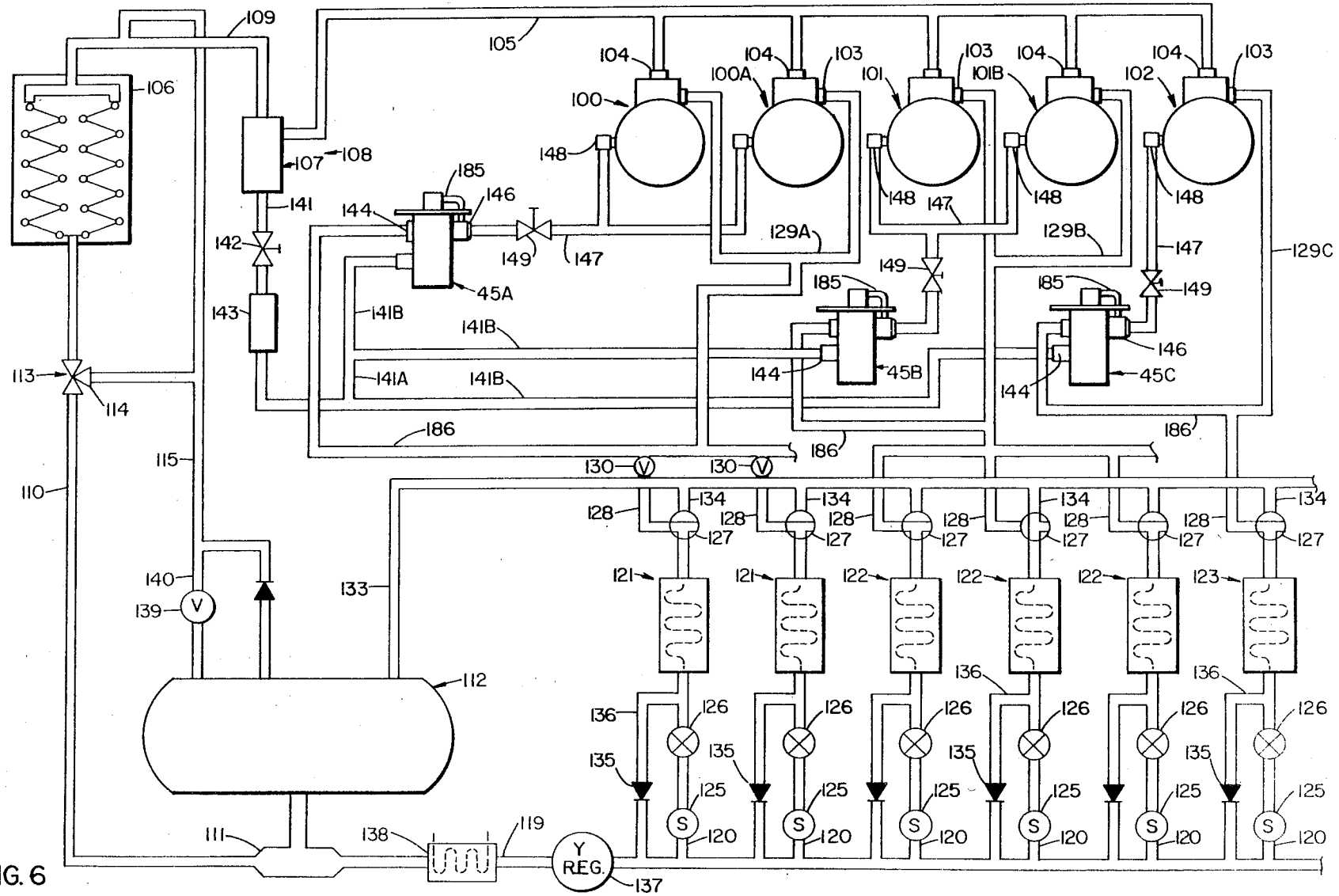
FIG. 6 is a diagrammatic view illustrating another embodiment of a multiple compressor oil return system of the present invention.

Referring now to FIG. 6, a different multiple compressor refrigeration system embodies an oil return system 108 of the present invention. In this embodiment, compressors 100 and 100A are coupled with a common suction header 129A, compressors 101 and 101A are coupled with a common suction header 129B and compressor 102 illustrates a single compressor subsystem having suction header 129C. The refrigerated fixtures (such as display cases, coolers, etc.) of a typical commercial foodstore operate over a wide range of low temperatures (frozen foods and ice cream) and standard or normal temperatures (fresh foods), and in each low or standard temperature system the suction temperatures of different fixtures may vary substantially. For instance, in a normal to high temperature multiple compressor system, fresh meat cases may require suction temperatures of 15° F. whereas produce cases may require 30° F. suction temperatures and store air conditioning may even be included in a multiplexed system with suction temperatures in the range of 45° F. Certain variations in suction temperature such as 5°–8° F. may be accommodated by E.P.R. valves in the suction branch conduits of various fixtures; but more substantial temperature/pressure variations cannot be compromised. More specifically to the point of the present invention, such temperature/pressure variations drastically effect the efficiency of oil return systems, and heretofore no oil system has been capable of optimum oil delivery performance in a multiplexed system of the type just described.

Still referrring to FIG. 6, the multiple compressors 100, 101 and 102 have their suction or low side service valves 103 connected to the respective suction headers 129A, 129B and 129C as aforesaid, and have a high pressure discharge 104 connected in parallel with a common discharge header 105 through which hot compressed gas is discharged to condenser 106. The discharge header 105 is connected to an oil separator and reservoir unit 107 of the type previously referred to and more fully described in parent application No. 442,967 (U.S. Pat. No. 4,478,050) and copending divisional application No. 599,468 (U.S. Pat. No. 4,506,523), and it will be clear that refrigerant vapor and oil are separated in this unit 107 and that the refrigerant is discharged from the unit through conduit 109 to the condenser 106. The refrigerant vapor is reduced to its condensing temperature and pressure in the condenser 106 which connects by conduit 110 to the T-base 111 of a surge-type receiver 112 forming a liquid refrigerant source for operating the system. The condenser flooding valve 113 and pilot control 114 from equalizing line 115 operate to produce variable condenser flooding to maintain compressor head pressures as described in FIG. 1. The liquid header 119 from the T-base 111 conducts refrigerant to branch lines 120 to the evaporator coils 121, 122 and 123 associated with various refrigerated fixtures (not shown) and representing numerous evaporators that may be connected in the sub-systems operated by the respective compressors 100, 101 and 102, respectively, as will be described. The branch line 120 of each evaporator 121, 122 and 123 has a solenoid valve 125, and expansion valves 126 meter refrigerant into the evaporators in a conventional manner. The outlets of the evaporators 121, 122 and 123 are connected to three-way valves 127 through branch suction lines 128 and to the suction headers 129A, 129B and 129C, respectively, under normal refrigerating conditions. E.P.R. valves 130 are shown interposed in the branch suction conduits 128 from evaporators 121 to suction header 127A to illustrate that the operative suction pressure acting on the evaporators 121 can be adjusted relative to the actual suction pressure of the compressors 100 and 100A, as will be more fully described.

The refrigeration system of FIG. 6 is also similar to that of FIG. 1 in showing a gas defrosting arrangement utilizing saturated gaseous refrigerant from the receiver 112 as the defrosting medium. A main defrost header 133 connects the top of the receiver 112 through branch lines 134 to the respective three-way valves 127, the center evaporator 122 being shown with its three-way valve 127 in the defrost position and the remaining evaporators maintain normal refrigeration to produce a large cumulative sensible and latent heat load of gaseous refrigerant for efficient defrosting purposes. Thus, gaseous refrigerant from the receiver 112 flows through defrost lines 133 and 134 and the three-way valve 127 of the selected evaporator coil (122) for heating and defrosting that coil and thereby condensing the refrigerant to liquid phase. The condensed refrigerant flows in by-pass relation to the expansion valve 126 and liquid branch line 120 through by-pass conduit 136 and its check valve 135 to return this condensate to the liquid line 119, and a pressure reducing valve 137 upstream in the liquid line 119 effects a pressure reduction relative to the defrost header 133. An evaporative sub-cooler 138 may be utilized to prevent flash gas, and a pressure regulating valve 139 may be provided in conduit 140 between the one-way equalizing line 115 and the receiver 112 to maintain a constant head pressure in the receiver during gas defrost.

The operation of the basic refrigeration system shown in FIG. 6 is like that of FIG. 1 except for the fact that multiple compressors of this system may work alone or in combination with other compressors in a variety of suction sub-systems having substantially different suction temperatures set to optimize the efficient operation of their respective evaporators. Thus, compressors 100 and 100A may have a saturated suction temperature and corresponding pressure relationship at 15° F. saturated for servicing fresh meat cases, the compressors 101 and 101A may operate at 30° F. saturated to service produce and dairy cases or the like, and the compressor 102 may operate at 45° F. saturated to run the store air conditioning. Obviously, the refrigerant for this entire system (i.e. R-12, R-22 or R-502) will be selected for its performance characteristics in the total system configuration. It will also be apparent that the effective head pressure in discharge header 105 will act in the oil separator unit 107 and that the differential pressure to the suction side 129A, 129B and 129C will be substantially different in these respective sub-systems and will have a direct bearing on effective oil return.

Still referring to FIG. 6 and the oil return system 108 thereof, the oil separator unit 107 may be of the type fully disclosed and claimed in parent application Ser. No. 442,967 (U.S. Pat. No. 4,478,050) and co-pending divisional application Ser. No. 599,468 (U.S. Pat. No. 4,506,523). In any event, gaseous refrigerant and oil vapor are separated in the unit 107, the refrigerant being discharged to the condenser 106 and the oil being accumulated in liquid form for return to the respective compressors 100, 101 and 102. An oil line 141 connects the liquid reservoir at the bottom of the unit 107 through a service valve 142 and filter 143 to an oil distribution header 141A, which connects by separate branch oil lines 141B to the inlet 144 of a pressure control valve 45 (such as that shown in FIG. 3) for the compressors of each evaporator sub-system. The compressors 100 and 100A operating at 15° F. will have a pressure control valve 45 (45A), and the compressors 101 and 101A will have a separate pressure control valve 45B, and the compressor 102 will have control valve 45C. The branch oil lines 141B connect the oil reservoir (107) to the inlets 144 of the respective control valves 45A, 45B, 45C and their oil outlets 146 are connected by oil return lines 147 to conventional oil float valves 148 which sense the oil level in the respective compressor crankcases and deliver or feed oil upon demand to maintain that oil level substantially constant. Shut-off valves 149 are provided in the lines 147 for service.

The function of each of the respective pressure differential control valves 45A, 45B and 45C is to reduce the high pressure prevailing in the oil separation unit 107 and also effective at the inlet 144 of each such valve to a pressure value slightly greater than the suction pressure of the compressors being serviced thereby. The construction and operation of the valve 45 (i.e. 45A, 45B and 45C) has been described with reference to FIGS. 3 and 5, and it is clear that the suction pressure of suction headers 129A, 129B and 129C of the sub-systems are imposed on the internal control diaphragms (83) of the valves through equalizer lines 186A, 186B and 186C, respectively. Therefore, irrespective of the substantial suction pressure differences in the various compressor sub-systems, the pressure drop or differential across each control valve 45 can be preselected and independently regulated for optimum efficient operation of the oil delivery valves 148 at each compressor. It will be readily apparent that the pressure regulating valve 45 (45A, 45B and 45C) of each sub-system maintains a preselected low side pressure differential between the oil return line 147 equalized by the upper diaphragm surface equalizing line 185 and the lower diaphragm surface equalized to suction line 186 for efficient oil float control to meet the lubrication requirements of the different compressors 100, 101 and 102.

What is claimed is:

1. An oil return system for a multiple compressor refrigeration system in which said compressors have a common high pressure discharge side and at least two of said compressors have a low pressure suction side connected to operate at different suction pressures, said oil return system comprising liquid oil reservoir means connected to the high pressure discharge side of said compressors, oil delivery means for sensing the oil level at the low pressure suction side of said compressors and for feeding oil to maintain such oil level for each compressor, and separate oil control valve means disposed between said reservoir means and said oil delivery means for each of said two compressors, said oil control valve means for each said compressor having pressure means responsive to the pressure differential between its own downstream oil outlet pressure and the suction pressure of said compressor being fed thereby for transferring oil from the reservoir means to the oil delivery means at a selected low side differential pressure relative to the compressor suction pressure acting thereon.

2. The oil return system according to claim 1, including a plurality of compressors operating at different suction pressures for operating refrigerated fixture evaporators in separate sub-systems at different suction pressure/temperatures from each other, said oil control valve means for each sub-system having pressure control means for reducing the high discharge pressures acting on said oil reservoir means to a substantially uniform low side differential pressure relative to the suction temperature/pressure thereon, and means for distributing liquid oil from said reservoir means to said oil control valve means.

3. The oil return system according to claim 2, in which said distribution means comprises an oil distribution header having an inlet connected to said reservoir means, and separate branch conduits connecting said header to the oil inlet side of said separate oil control valve means.

4. An oil return system for a refrigeration system having multiple compressors, condenser-receiver and evaporator means, at least two of said compressor means having low pressure suction sides operating different sub-systems of evaporator means at different suction temperatures and all of said compressor means having a common discharge header to said condenser-receiver means, said oil return means including means for the separation of oil and refrigerant passing through said discharge header and means forming a reservoir of liquid oil, and oil return means connecting said liquid oil reservoir to each compressor means including oil level delivery means responsive to the oil level of an associated compressor means and pressure differential control means for each compressor means operating at a different suction pressure, each of said differential control means including valve means responsive to oil outlet pressure therefrom and compressor suction pressure acting in opposition for reducing the high oil pressure from said reservoir to a preselected low pressure differential for regulating oil delivery to said oil level delivery means.

5. The oil return system according to claim 4, in which said oil level delivery means comprises an oil float valve responsive to the oil level of its associated compressor means for feeding oil upon demand to maintain such oil level.

6. The oil return system according to claim 5, in which a plurality of said pressure differential valve means are provided for the compressor means of the respective evaporator sub-systems operating at different suction pressures, said plurality of pressure differential valve means being disposed in oil return lines between said oil reservoir and said oil float valves of the respective compressor means, said pressure differential valve means being constructed and arranged to produce a substantial drop in oil pressure thereacross from the high side oil pressures prevailing in said reservoir to preselected low side pressure differentials relative to the suction pressures of said different compressor means.

7. The oil return system according to claim 6, in which each said pressure differential valve means includes means for establishing a fixed pressure relationship between the suction pressure of its associated compressor means and its own downstream oil pressure, and means for adjusting said last-mentioned means to change the selected pressure differential.

8. The oil return system according to claim 7, including oil distribution means comprising a distribution header connected to the outlet of said oil reservoir, and separate branch conduits connecting said header to the oil inlet of pressure differential valve means to the respective compressor means for each evaporator sub-system.

9. In a refrigeration system having multiple compressors operating at different low pressure suction temperatures for the refrigeration of separate sub-systems of fixture evaporators, said compressors having a common high pressure discharge header and condenser-receiver means for supplying liquid refrigerant to all of such sub-system evaporators; the improvement comprising an oil system for said compressors comprising means connected to the high pressure discharge header for separating refrigerant and oil and forming a reservoir of liquid oil, means for metering oil to the respective compressors to maintain preselected oil levels in the low pressure suction side thereof, and multiple oil control valves for the compressors of each sub-system having different suction temperatures, said oil control valve being constructed and arranged to respond to preselected pressure differentials established between their own downstream oil pressure and the respective compressor suction pressures acting thereon to produce a substantial oil outlet pressure drop relative to the high pressure oil inlet pressure from said reservoir.

* * * * *